United States Patent [19]

Liljeström et al.

[11] Patent Number: 4,860,679

[45] Date of Patent: Aug. 29, 1989

[54] ICE BREAKER VESSEL

[75] Inventors: Göran Liljeström, Västra Frölunda; Bengt Johansson, Calgary, both of Sweden

[73] Assignee: Gotaverken Arendal AB, Goteborg, Sweden

[21] Appl. No.: 184,403

[22] Filed: Apr. 20, 1988

[30] Foreign Application Priority Data

Apr. 27, 1987 [SE] Sweden ..... 8701716

[51] Int. Cl.[4] ..... B63B 35/08

[52] U.S. Cl. ..... 114/40; 114/163; 440/71

[58] Field of Search ..... 114/40, 41, 42, 57, 114/162, 163, 164, 166; 416/247 A; 440/66, 67, 71

[56] References Cited

U.S. PATENT DOCUMENTS

| | | | |
|---|---|---|---|
| 2,344,433 | 3/1944 | West | 114/163 |
| 4,085,694 | 4/1978 | Schilling et al. | 114/163 |
| 4,493,660 | 1/1985 | Becker et al. | 440/67 |

FOREIGN PATENT DOCUMENTS

| | | | |
|---|---|---|---|
| 935835 | 11/1955 | Fed. Rep. of Germany | 114/163 |
| 2241840 | 4/1974 | Fed. Rep. of Germany | 114/41 |

OTHER PUBLICATIONS

Derwent Abstract No. 85145652/24.

*Primary Examiner*—Joseph F. Peters, Jr.
*Assistant Examiner*—Jesûs D. Sotelo
*Attorney, Agent, or Firm*—Wegner & Bretschneider

[57] ABSTRACT

An ice breaker vessel and a method for increasing maneuverability and protecting the propellers against broken ice when going backwards. The ice breaker has two stern propellers and a steering rudder aligned with each propeller shaft. Each of the rudders is individually rotatably mounted on a vertical rudder stock adjacent half the cord of the rubber blade profile length, and connected to a rudder gear, so that they e.g. may converge or diverge in the direction backwards, in abutment with end stops positioned on the stern of the ice breaker vessel, when the rudders are in their respective end positions. The method comprises turning the steering rudders in opposite directions until they cooperate and for backwards converging rudder surfaces.

9 Claims, 7 Drawing Sheets

ICE BREAKER VESSEL

FIELD OF THE INVENTION

The present invention relates to an ice breaker vessel and a method for increasing maneuverability and protecting the propellers against broken ice when going backwards, wherein said ice breaker has two propeller shafts and a steering rudder aligned with each shaft, each of said rudders being rotatable about a vertical axis.

BACKGROUND OF THE INVENTION

When assisting a ship which no longer is able to progress through the ice, e.g. as a result of an ice ridge, an ice breaker vessel has to maneuver in along side the ship, break through the ice ridge and turn in immediately in front of said ship. The maneuver resembles a close "overtake". Often the ice breaker vessel subsequently has to back up towards the ship that needs assistance, in order to transmit a tow line. Ice breaking vessels are normally equipped with two propellers and a steering rudder in the longitudinal direction of each shaft. During backing maneuvers, the rudders and propellers are especially vulnerable to the impact of broken ice. In order to reduce the stress on the rudders, ice breaker vessels normally are equipped with ice wedges, which are mounted at the bottom skin, in the longitudinal direction of each propeller shaft, behind the rudder. Damages on the rudders may be avoided by positioning the rudders in parallel with the centerline of the ship. The propellers will nevertheless be worn by contact with broken ice.

SUMMARY OF THE INVENTION

The object of the present invention is to provide a method and means for reducing the amount of broken ice that may hit the propellers and rudders when going astern with an ice breaker vessel which is equipped with two propellers. The invention also aim for enhanced maneuverability for these vessels.

For this object, the method according to the invention comprise turning the steering rudders in opposite directions until they cooperate and form backwards converging rudder surfaces, at end positions being defined by end stop means.

Preferably the end stop means permit the rudders to be rotated until they converge backwards at an angle of about 40°.

Preferably the end stop means permit the rudders to be rotated until they diverge backwards at an angle of about 70°.

The ice breaker vessel according to invention comprise two stern propellers and a steering rudder aligned with each propeller shaft, said rudders being individually rotatably mounted on a vertical rudder stock adjacent half the cord of the rudder blade profile length, and connected to a rudder gear, so that they e.g. may converge or diverge in the direction backwards, in abutment with end stop means positioned on the stern of the ice breaker vessel, when the rudders are in their respective end positions.

Preferably, when in the backwards converging rudder position, each steering rudder abuts the respective end stop means with a stern surface.

Preferably, each steering rudder abuts the respective end stop means with a frontal surface, when in the backwards diverging rudder position.

According to one preferable embodiment of the invention, each end stop means is mounted diagonally behind and transversely inside of the respective rudder stock.

Preferably the upper part of the rudders, adjacent the bottom skin, is widened and has an aperture for the end stop means, so that they, in the backwards converging rudder position, cooperate and form diagonally backwards-inward directed ice wedges.

Preferably the steering system of the ice breaking vessel is provided with means for automatically rotating of the steering rudders to the rearward converging rudder position, when the thrusts of the propellers are reversed for going astern.

BRIEF DESCRIPTION OF THE DRAWINGS

One embodiment of the invention will now be described in detail with reference to the accompanying drawings, in which.

DESCRIPTION OF A PREFERRED EMBODIMENT

Figure 1:
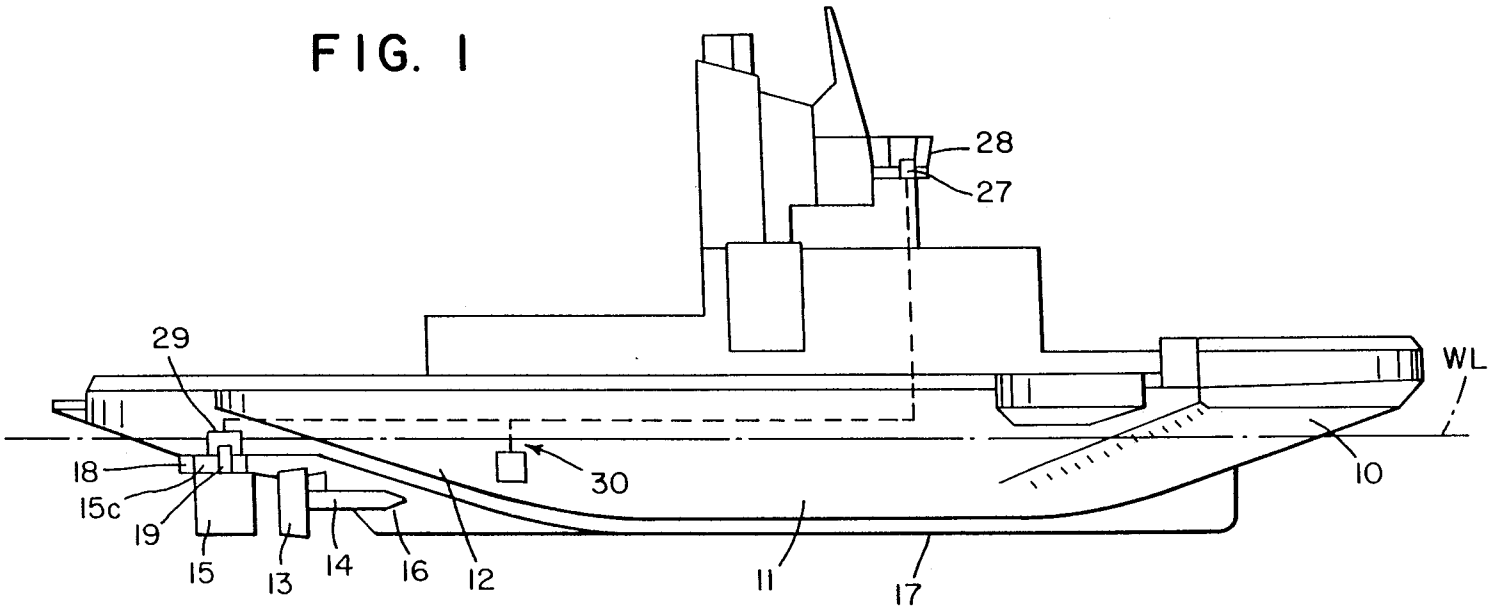
FIG. 1 is a side view of an ice breaker vessel according to the invention.

The stem, the midships section and the stern are designated with the reference numbers 10, 11 and 12 respectively. The vessel is equipped with two shrouded propellers 13 and vertically rotatably journalled steering rudders 15, each of which is mounted in the extension of the respective propeller shaft axis. The propeller shafts are carried through skegs 16 which protrude from the stern 12. An ice wedge 18 is mounted adjacent the bottom skin 17 of the vessel, diagonally behind each rudder, said wedges are more clearly seen in FIG. 2 and 3 of the drawings.

Figure 2:
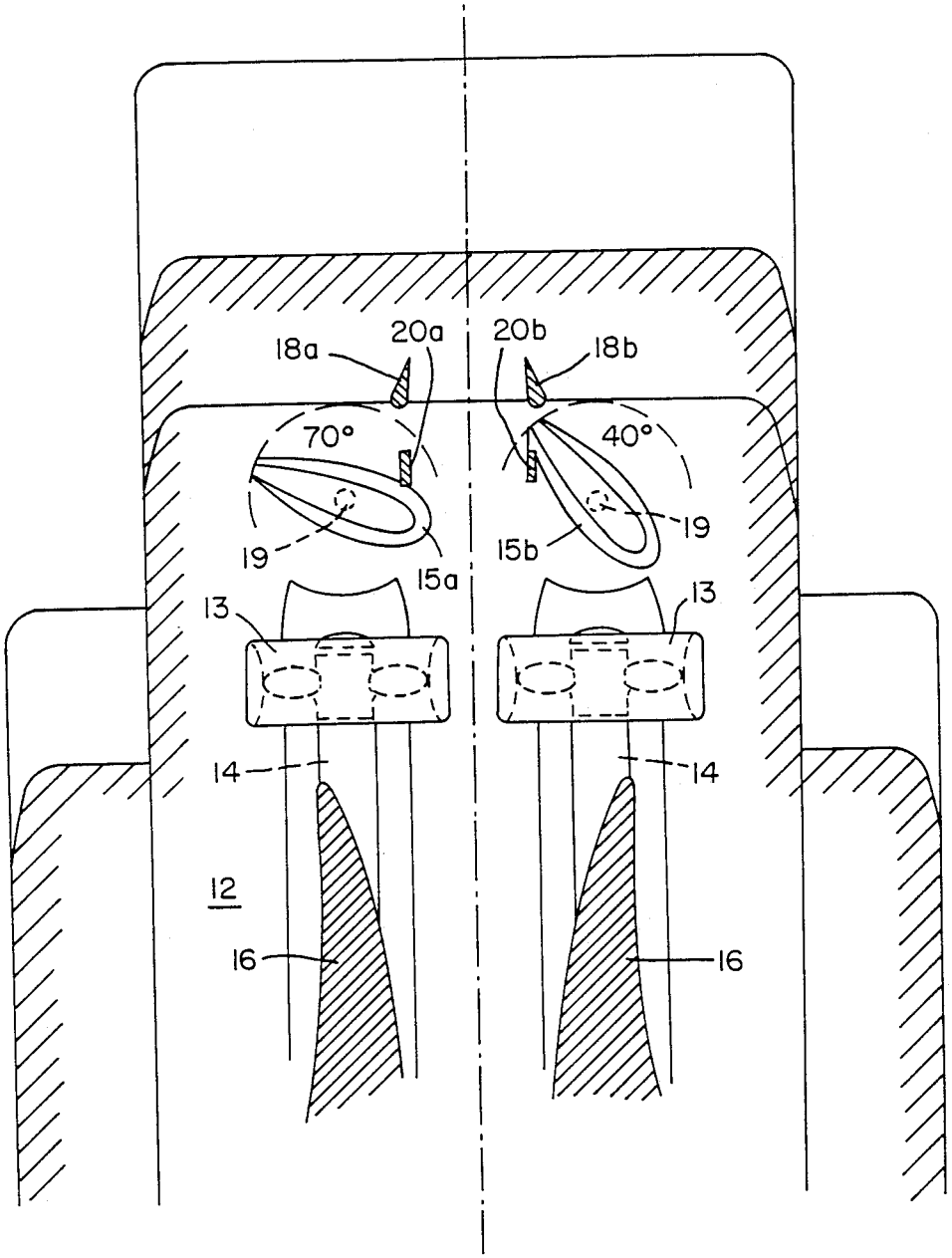
FIG. 2 and 3 shows the stern of the ice breaker, in a plane view from below, in a larger scale, FIG. 4 and 5 in a broken side view show one of the rudders of the ice breaker in an even larger scale, together with an end stop, and FIG. 6 to 8 diagrammatically show the rudder and end stop in an even larger scale, in three different positions.

FIG. 2 shows how the rudder stocks 19 are mounted in the extension of the propeller shaft axis. The ice wedges 18, however, are mounted so that they are displaced towards midships. Immediately in front of the ice wedges, are end stops 20 provided for the rudders 15. In the rudder position shown in FIG. 2 the vessel performs a turn to port with maximal rudder angle. In this case the port rudder end stop **20*a* permits the port rudder 15*a* to take a "toe-in" angle of 70°, while the end stop 20*b*, allows the starboard rudder to take a "toe-out" angle of 40°. Corresponding angles are of course possible for a turn to starboard. The upper part 15*c* of each rudder is widened in the area of the respective ice wedge 18 and end stop 20**.

Figure 3:
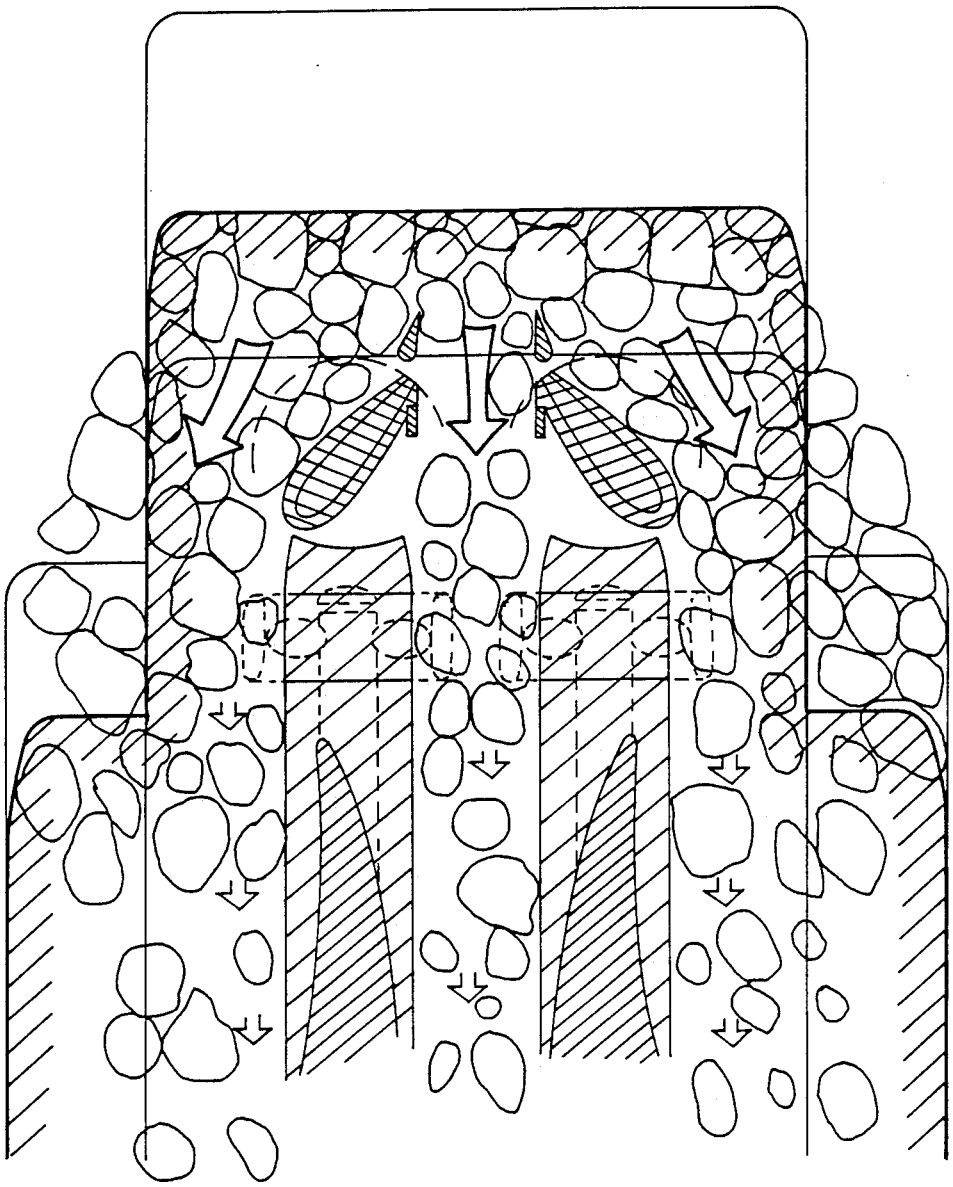

FIG. 3 shows the rudders in position for going astern. In this case both rudders **15*a* and 15*b* take the position of maximum "toe-out", i.e. a 40° angle to the respective end stop. The result of this is that the entire backwardly projected rudder area forms as deflectors in front of the shrouded propellers 13 and protect them from broken ice 21**. The opposite rudder position, i.e. with the rudders in 70° angle to the centerline of the ice breaker vessel, may be used for clearing a broken channel of broken ice, as the propeller thrusts is diverged to the sides by the rudder blades.

When going astern with the vessel, i.e. with the rudder blades in the position of maximum "toe-out", steering is affected by varying the rotation speed or pitch of the propellers. This results in a powerful deflection of the propeller thrust, if one of the propeller thrusts is directed backwards for a short instant, greatly enhancing maneuverability compared to conventionally designed sterns.

Figure 5:
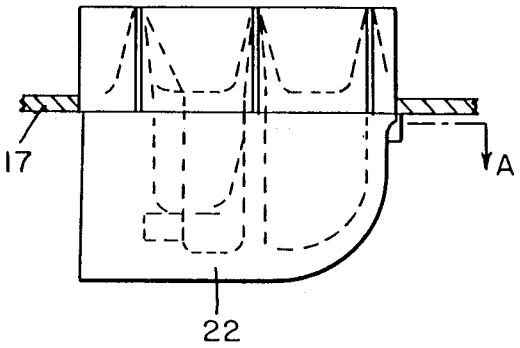
Figure 4:
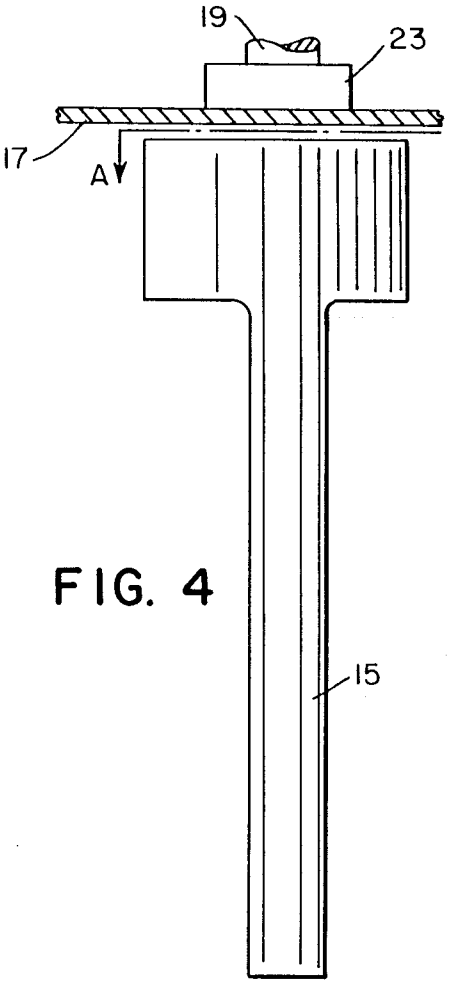

In FIG. 1–3 one embodiment of the invention is shown in which the ice wedges 18 and the end stops 20 are separate units. FIG. 4–8 shows another embodiment of the invention in which the ice wedges and the end stops are built together as one unit 22. This results in a stronger and more sturdy design. FIG. 4 shows the rudder 15 seen from the direction of the front with the journal 23 for the rudder stock 19 in the bottom skin 17, wherein the width relations of the upper wider part 15*c* and the rest of the rudder blade is evident. FIG. 5 shows the combined ice wedge and end stop 22 in a side view.

Figure 6:
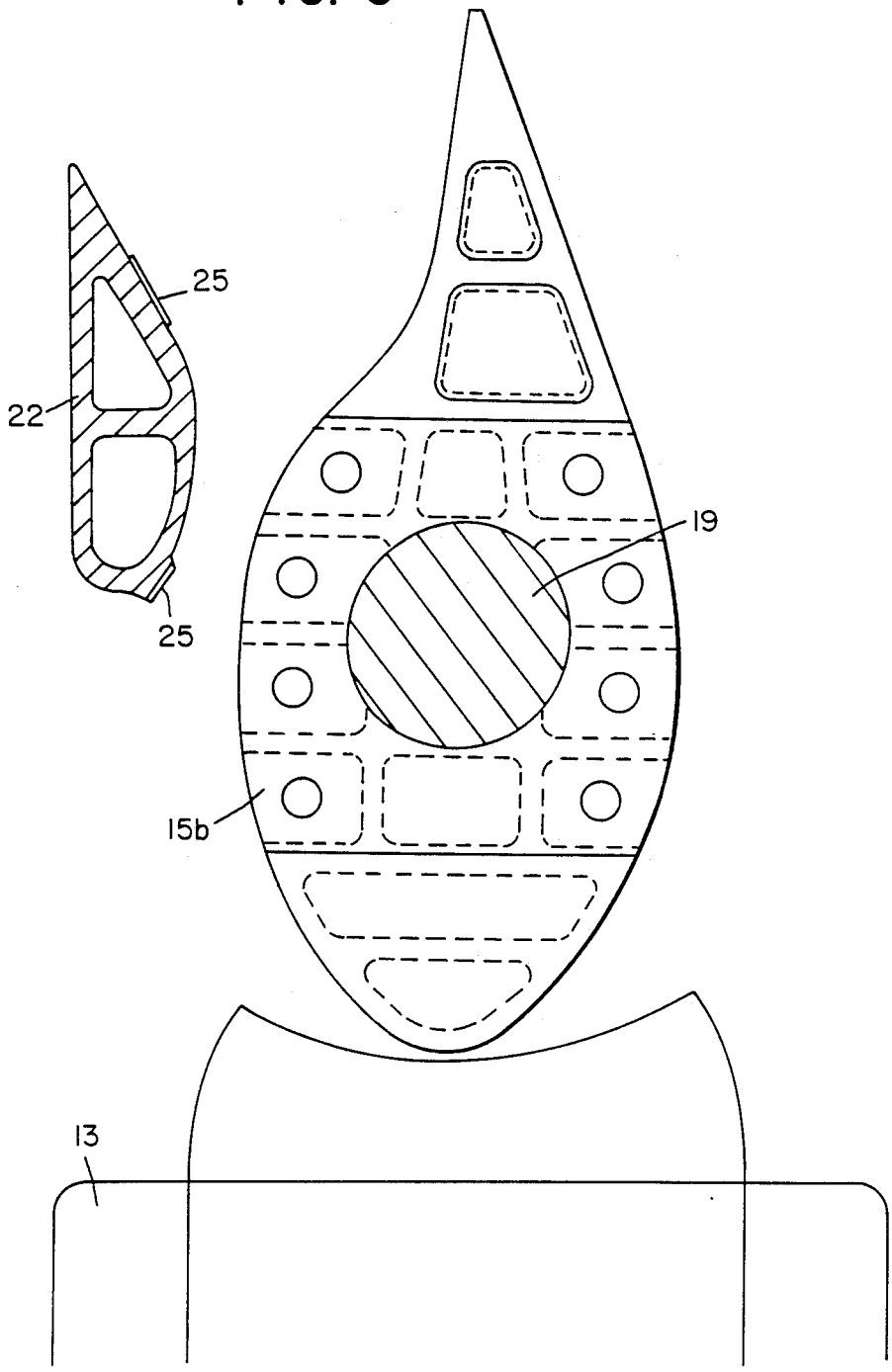
Figure 7:
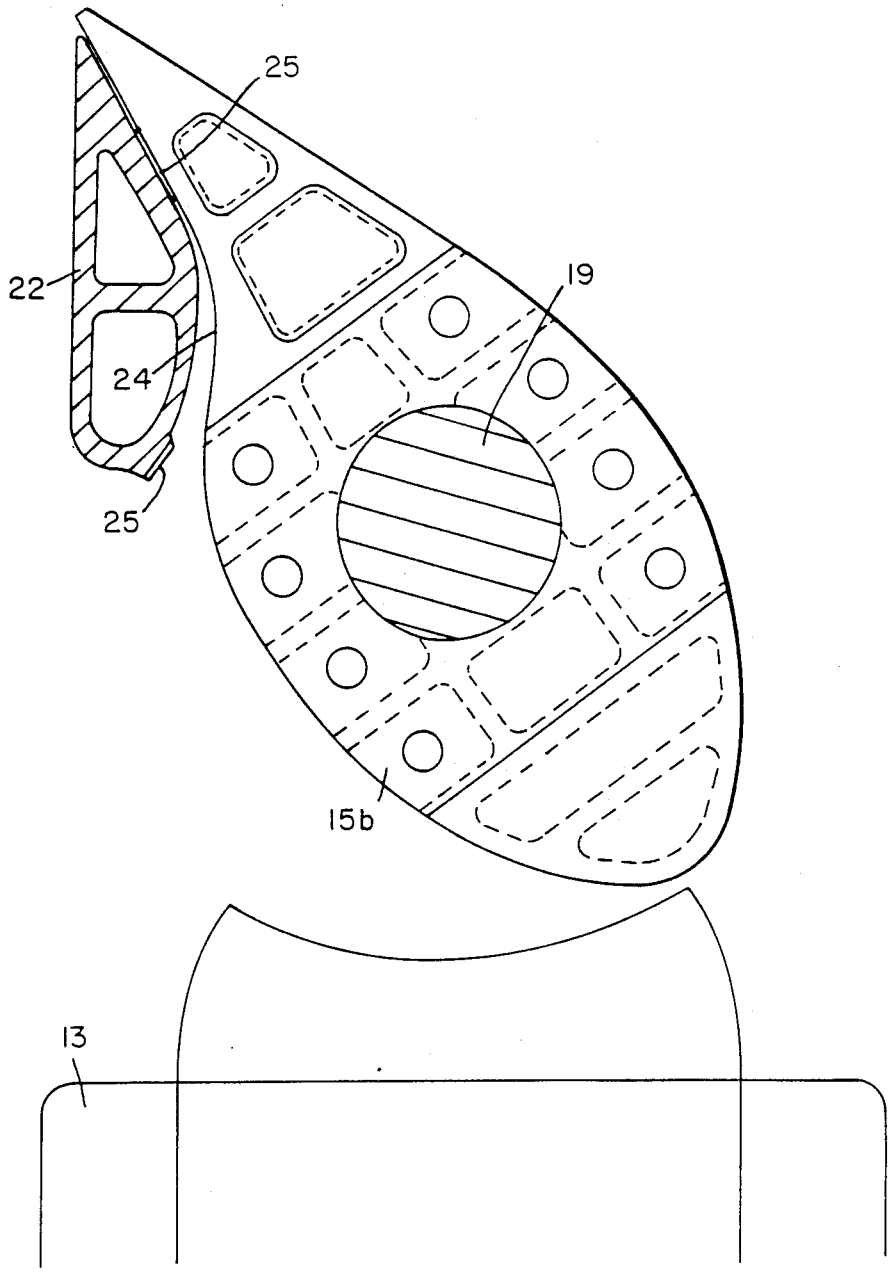
Figure 8:
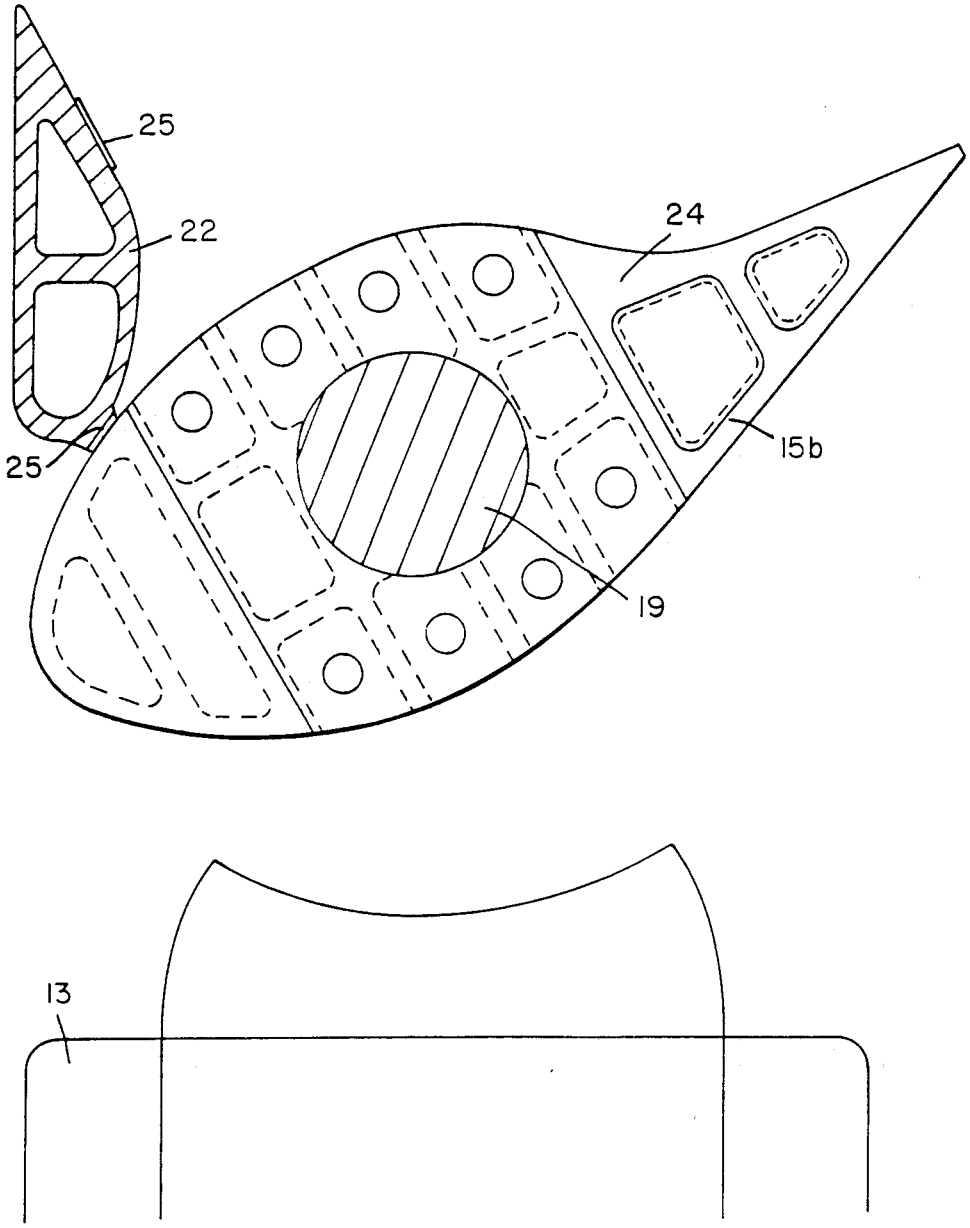

FIG. 6–8 are sections along the line A—A in FIG. 5 seen from the above, and show one of the rudders in a neutral position, in a position of maximum "toe-out", and in a position of maximum "toe-in", respectively. From this it is clear how the upper wide part 15*c* of the rudder 15 is formed with a recess 24 for the end stop 22, who in the cooperating end position (see FIG. 7) form an obliquely backwards-inward pointing ice wedge. The end stop is provided with machined contact surfaces 25, cooperating with the rudder.

The steering gear controls of the ice breaker are preferably arranged so that the steering rudders are automatically rotated to the rearward converging rudder position, when the thrusts of the propellers are reversed for going astern. Since the rudder stocks 19 are positioned more close to the centre of the profile than normally in the field of the art, the drag forces on the rear halves of the rudders will be reduced when going astern. Besides, since the rudders cooperate with the end tops when going astern, forces on the rudder stock journals will be reduced.

The steering controls 27 are shown schematically in FIG. 1 located in the bridge 28 and connected to a steering machine 29. The interconnection of the steering controls 27 with the propeller controls is shown schematically at 30.

The invention is not limited to the above described embodiments, but several modifications are possible within the scope of the accompanying claims. For example, the end stops 20, 22 may be positioned for other maximal rudder angles.

We claim:

1. A method for an ice breaker vessel, for increasing maneuverability and protecting the propellers against broken ice when going backwards, wherein said ice breaker has two propeller shafts and a steering rudder aligned with each shaft, each of said rudders being rotatable about a vertical axis, comprising turning the steering rudders in opposite directions until they cooperate and form backward converging rudder surfaces, at end positions being defined by end stop means.

2. A method according to claim 1, wherein the end stop means permit the rudders to be rotated until they converge backwards at an angle of about 40°.

3. A method according to claim 2, wherein the end stop means permit the rudders to be rotated until they diverge backwards at an angle of about 70°.

4. An ice breaker vessel having two stern propellers and a steering rudder aligned with each propeller shaft, said rudders being individually rotatably mounted on a vertical rudder stock adjacent half the cord of the rudder blade profile length, and connected to a rudder gear, so that they may move between a first position in which they converge and a second position in which they diverge in the direction backwards, in abutment with end stop means positioned on the stern of the ice breaker vessel, when the rudders are in their respective end positions.

5. A vessel according to claim 4, wherein each steering rudder, when in the rearward converging rudder position, abuts the respective end stop means with a stern surface.

6. A vessel according to claim 5, wherein each steering rudder, when in the backwards diverging rudder position, abuts the respective end stop means with a frontal surface.

7. A vessel according to claim 6, wherein each end stop means is mounted diagonally behind and transversely inside of the respective rudder stocks.

8. A vessel according to claim 7, wherein the upper part of the rudders is widened adjacent the bottom skin of the vessel, and a recess for the end stop means, so that they, in the backwards converging rudder position, cooperate and form diagonally backward-inward directed ice wedges.

9. A vessel according to any of the claims 4–8, wherein the ice breaking vessel has a steering system which is provided with means for automatically rotating of the steering rudders to the rearward converging rudder position, when the thrusts of the propellers are reversed for going astern.

* * * * *